United States Patent [19]

Bodet et al.

[11] Patent Number: 4,663,870

[45] Date of Patent: May 12, 1987

[54] DISPLAY APPARATUS HAVING PIVOTABLE SEGMENTS

[76] Inventors: Jean-Pierre Bodet, La Haicoup, Route des Poteries Vezins; Gérard Supiot, Les Jonquiéres, rue de l'Evre, both of 49340 Trementines, France

[21] Appl. No.: 690,608

[22] Filed: Jan. 11, 1985

[30] Foreign Application Priority Data

Jan. 22, 1984 [FR] France ..... 84 00417

[51] Int. Cl.[4] ..... G09F 9/00

[52] U.S. Cl. ..... 40/449; 40/447; 340/815.05; 340/815.27

[58] Field of Search ..... 40/449, 446, 447, 450, 40/451; 340/815.04, 815.08, 815.5, 815.27, 815.12, 815.24, 815.29

[56] References Cited

U.S. PATENT DOCUMENTS

| | | | |
|---|---|---|---|
| 3,025,512 | 3/1962 | Bloechl | 40/449 |
| 3,096,594 | 7/1963 | Skrobisch | 40/449 |
| 3,295,238 | 1/1967 | Winrow | 40/449 |
| 3,942,274 | 3/1976 | Winrow | 40/449 |
| 3,947,984 | 4/1976 | Winrow | 40/449 |
| 4,006,476 | 2/1977 | Romney | 40/449 |
| 4,117,478 | 9/1978 | Skrobisch | 40/449 |
| 4,161,832 | 7/1979 | Bergamini | 40/451 |
| 4,327,357 | 4/1982 | Skrobisch | 340/815.29 |
| 4,380,879 | 4/1983 | Seibert | 40/447 |
| 4,389,804 | 6/1983 | Seibert et al. | 40/447 |

FOREIGN PATENT DOCUMENTS

| | | | |
|---|---|---|---|
| 771356 | 11/1967 | Canada | 40/449 |
| 0054336 | 6/1982 | European Pat. Off. . | |
| 2735254 | 4/1978 | Fed. Rep. of Germany . | |
| 2379120 | 8/1978 | France . | |
| 1471094 | 4/1977 | United Kingdom | 40/449 |

*Primary Examiner*—Gene Mancene
*Assistant Examiner*—J. Hakomaki
*Attorney, Agent, or Firm*—Sandler & Greenblum

[57] ABSTRACT

A display apparatus in the form of a container having display units mounted in subcontainers situated on the interior of the container bottom. Each of the display units has a display segment mounted for pivoting, and a motor for pivoting the segment. Each motor has male terminals extending through an orifice in the bottom of the subcontainer, two support elements which form flexible side plates and a reel for receiving a wire, a rotor mounted between the side plates, and an armature for the reel. The rotor includes a circular magnet mounted on end elements nestable in each other through the magnets central hollow space. Each end element nests in one of the side plates. The display apparatus also includes a plate mounted on the exterior of the container bottom. The plate has female receptors which receive the motor male terminals to form electrical connections, and a printed circuit which connects the electrical connections to a bayonnet connector.

11 Claims, 4 Drawing Figures

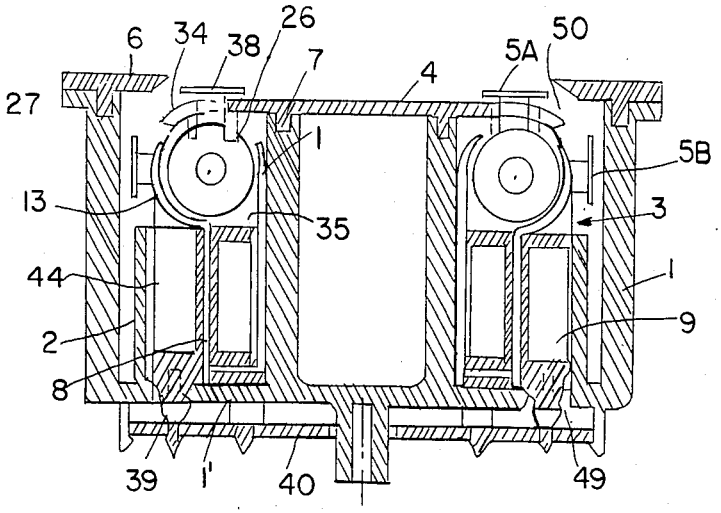
FIG. 4.
FIG. 2.
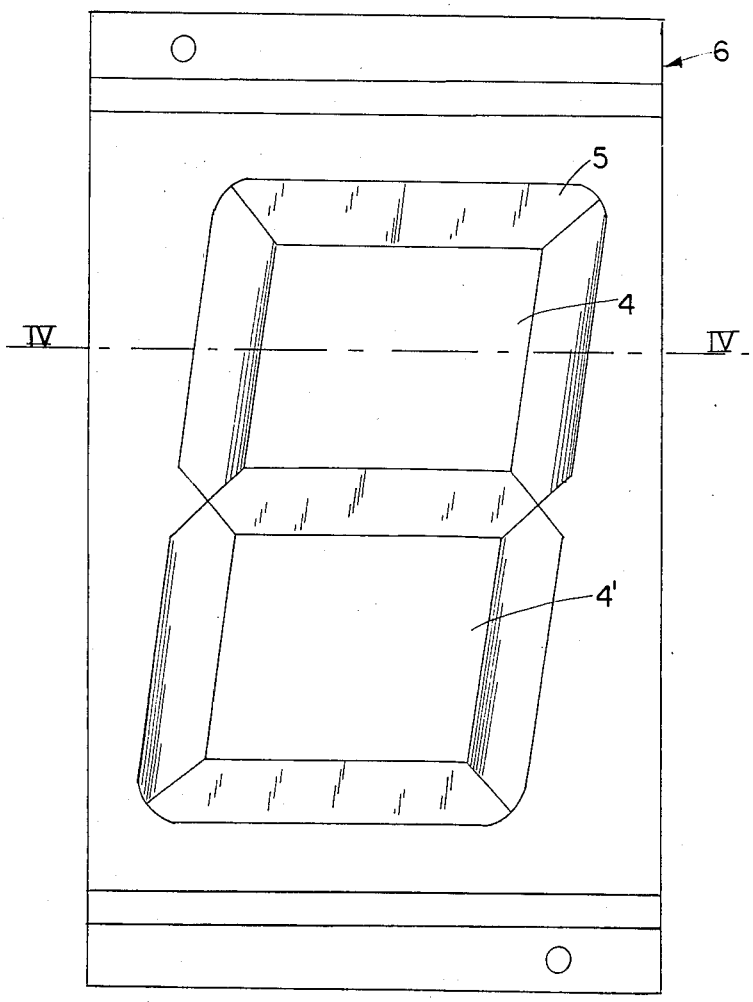

DISPLAY APPARATUS HAVING PIVOTABLE SEGMENTS

The present invention relates to a display apparatus for numbers or the like having pivotable segments of the type which is described in U.S. Pat. No. 3,096,594 filed June 17, 1960 in the name of Alfred SKROBISCH.

In apparatus of the above type, each segment is controlled by an individual motor, and the different elements are secured between two metallic plates, allowing for windows for viewing the segments only when they are in the displayed position. The construction of such apparatus is delicate and costly and moreover, in the case of breakdown, the replacement of the defective element requires prolonged stopping of the apparatus.

To overcome this disadvantage and others, the inventor had the idea of providing an apparatus of the above type characterized in that each segment and its motor are mounted on the elements of a single support which form a removable unit called a "block", that each block is positioned in a small individual container which is opened towards the front that the individual containers rise from the end of the container in a number equal to that of the segments and in that they are positioned as a function of the display positioning of the said segments; everything is associated in a manner such that each block is maintained in its opening in a manner so as to allow for its removal and replacement independently of the other blocks, after momentarily lifting of the cover and possibly of the other covers.

The corresponding bottom of each small container comprises an orifice through which the terminals of a motor extend. The internal walls of each small container cooperate with the periphery of the block such that the block can be easily slid into its opening by simple insertion during assembly. In the case of breakdown it is easy to change only the malfunctioning block without having to change the entire box.

The motor-segment block comprises:

a support made of plastic material formed of two sides which are easily nestable within one another, to define the body of a superimposed reel having two parallel side plates which are flexible between which the rotor is mounted, a stator comprising the wire of the reel and its armature formed on the one hand, by an iron axial to the said reel (core) and extending beyond it upwardly in the arc of a circle, and on the other hand, a substantially square iron of which a portion is placed flat under the reel while the other portion runs along the reel and is extended by an arced end positioned facing the arced portion of the other iron (on each side of the rotor magnet);

a rotor comprising a circular magnet positioned between two plastic elements on an axis mounted between the support side plates; and a segment comprising a blade wheel with two fingers which are attachable on the plastic elements of the rotor.

To better explain the invention, there is now given a simple example for illustrating a numeric device, with reference to the annexed drawings in which:

FIG. 2 illustrates the general appearance of the surface of the assembled container, when showing the numeral "8", FIG. 4 is a cross-sectional view along IV—IV FIG. 2.

Figure 1:
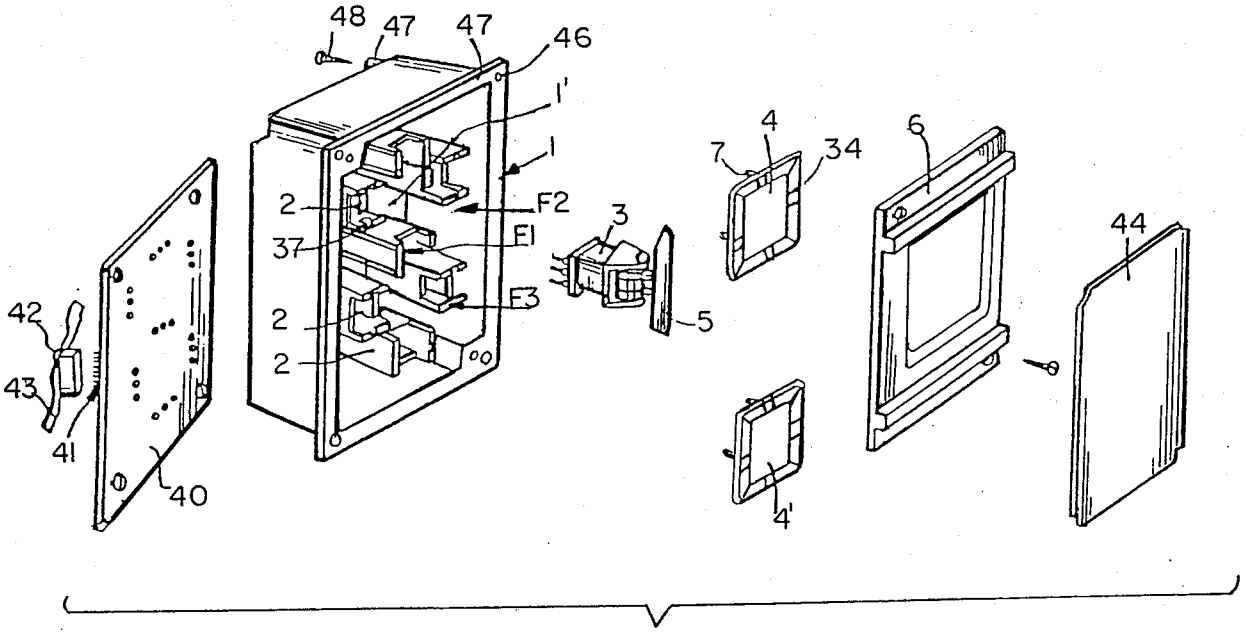
FIG. 1 is a perspective exploded view of the apparatus assembly.

The apparatus shown in its entirety in perspective exploded view in FIG. 1, comprises as principal elements:

a container 1 made of molded material, preferably plastic, formed with a bottom 1' and four sides. From bottom 1' rise, by direct casting or molding, seven small containers 2;

blocks 3 (for further clarity only a single one has been shown) to be press-fitted within a small container 2 along narrow F1, one block 3 per small box 2;

two covers 4—4' which are positioned on the interior of the box at the locations indicated by the arrows F2 and F3, allowing a certain amount of empty space around them;

a cover 6 which has in a conventional manner a large window.

To facilitate the understanding of the invention the construction of block 3 shown in FIG. 3 will first be described in detail.

This block 3 is composed of:

a support made of plastic material formed by a left side 10, a right side 11, both injected and provided to nest within one another when fitted together, and to remain nested by means of projections 12 illustrated on side 11 which will enter into corresponding holes of side 10. The configuration of these two sides 10–11 is as shown in FIG. 3 in a manner so as to define a body 8 of reel 44 (of which the base constitutes the socket of the block) and two side plates 36–35. These two sides 10–11 which constitute the support of the motor will receive, after their nesting, first the reel of electric wire 9, then the rotor such as is described below. So as to be able to position the rotor between the two side plates 35–36, these have at their lower portion an opening 35" and 36", which allows the side plates 35 and 36 to elastically open, and to receive the rotor and afterwards closing thereon. The correct spacing of the two side plates 35 and 36 is obtained by virtue of the nesting of dovetails 35' and 36' in their opening in container 2, as is described below.

Figure 3:
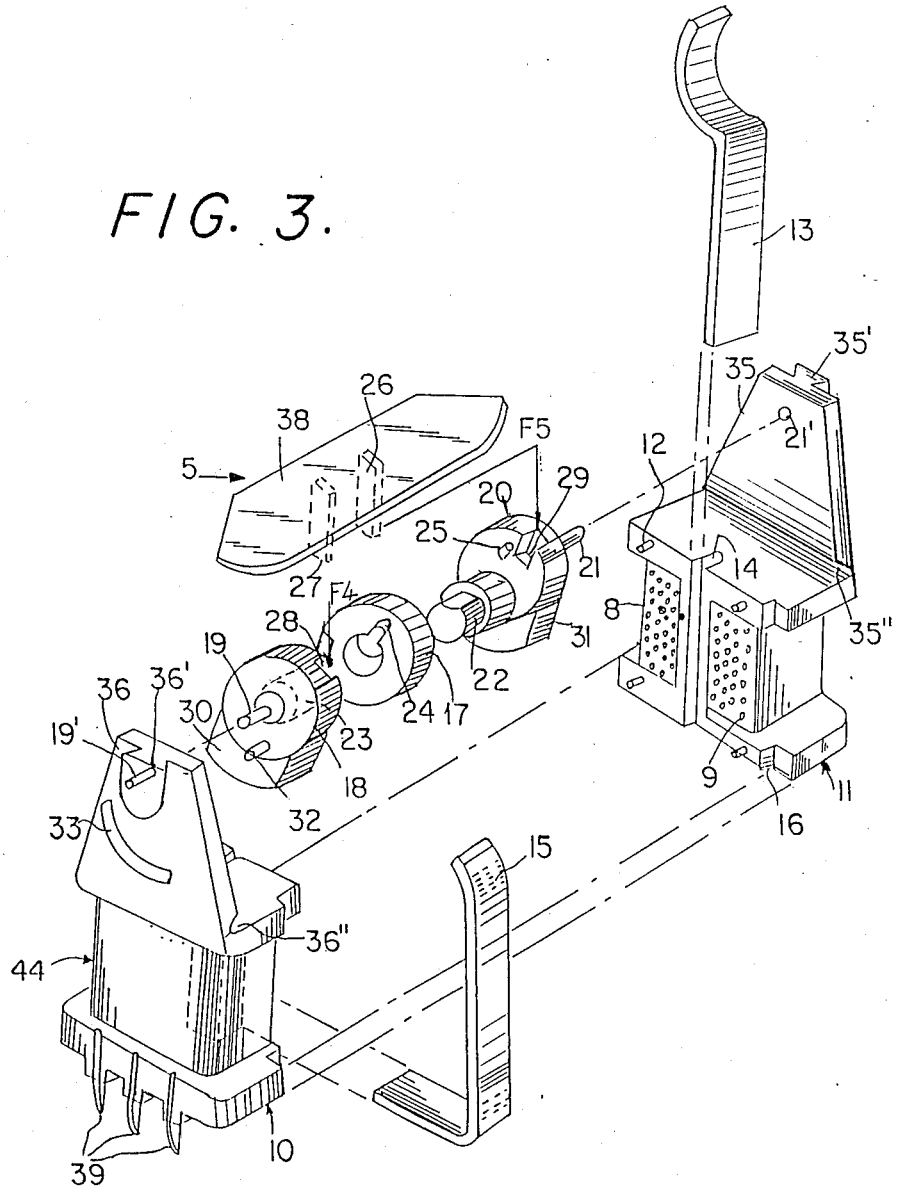
FIG. 3 is a perspective exploded view of the motor-segment block.

The stator elements 13 (nesting in slot 14) and 15 (pinioned in a groove 16), these two stator elements have been designed to have an optimum torque around the magnetic rotor 17, they have the form shown in FIGS. 3 and 4. These two stator elements constitute the armature of the reel 44 which is shown in cross-section in FIGS. 3 and 4, and which, depending upon the excitation which they receive will form a north pole at 13 and a south pole at 15, or south pole at 13 and north pole at 15.

the rotor is formed of three principle elements:

a magnet 17, a left end element 18 which carries a pivot 19 which is nested in a hole or pad 19' on the side 10 of the support;

a second plastic end element 20 which carries a pivot 21 which is embedded in the pad 21' of the support surface 11.

These two elements 18–20 which are shown spaced from one another in the exploded view (FIG. 3) are, in reality, brought together and nested by virtue of a hexagonal male nesting 22 which enters into female nesting element 23. During this nesting movement, a magnet 17 is positioned on portion 22. In the example shown this magnet 17 comprises a hollow space 24 in which a spur 25 nests in a manner such that magnet 17 is perfectly positioned on its axis defined by elements 23–22.

At the same time as one assembles these rotor elements, one positions the two fingers 26–27 of the wheel blade 38 (constituting the segment 5) in two cutouts 28–29 adapted to receive them in elements 18 and 20, along arrows F4 and F5.

It follows from what has just been described that the rotor which is composed of three principle elements 18-17-20 and of segment 5, assembles without any screws nor gluing, by a simple operation of placing the elements facing one another.

The rotor elements 18 and 20 comprise raised portions 30 and 31 which by virtue of their weight balance the wheel blade 38. This balancing can also be obtained in any other manner, for example by the addition of weights on elements 18 and 20. It will be easily understood that this balancing makes it possible for the rotor-segment assembly to pivot very rapidly and also both in one direction as well as the other, and to remain in the position where it has been directed. A projection 32, serving as a stop, is provided on element 18 to limit the pivoting of the wheel blade 38 along an angle of approximately 90° (to appear or disappear depending upon the excitation or not of the motor). To this end projection 32 is displaced in a slot 33 in the arc of a circle and of appropriate length, provided in side plate 36.

This rotor thus constituted is supported by pads 19' and 21', provided in the side plates 36 and 35 of the sides 10 and 11 which are secured between them by virtue of the small projections 12.

At the lower portion of the support 10–11, on an axis of the body 8 of reel 44, the wire 9 is wound. The ends of wire 9 leave at the lower portion where it is provided with eyelets terminals or pins 39. Block 3 comprises attachment means (clips) in the containers 2. In the example illustrated these means are constituted by appendices 35'–36' which extend outside of the upper portion of the side plates 35–36.

This dove-tailed "clip" which is adjusted within container 2, is likewise necessary to maintain a very precise spacing between the side plates 35 and 36 between which the rotor pivots.

It has been seen that container 1 is composed of an end 1' having four sides, such that it is possible to close it by a cover plate 6, and from this end 1' extend which is directly molded, seven small containers (2) which form the seven openings of the seven blocks 3, supports of the seven segments 5 adapted to form a numeral "8".

Each small container 2 and each block 3 have complimentary forms of substantially square cross-section. The bottom of container 2 is constituted by a portion of bottom 1' of container 1, and it is in this position that is bored with orifices 49 provided for the passage of pins 39. From this bottom 1', through box 2, extend four vertical walls of which two of low height face one another, but they are sufficient such that the four walls constitute a base which envelopes the socket of block 3. The higher walls serve as a guide and they comprise a groove 37 to receive the appendices 35'–36'. The upper edges of the boxes 2 define a plane parallel to that of cover 6, at a short distance from the latter within the box (FIG. 1).

The assembly (support 10–11, the motor, and the segment 5) constitutes a block 3, which is formed separately from the box 1 and its individual boxes 2. Block 3 is easily gripable between the fingers and is easy to manipulate. By virtue of the fact also that each small container 2 comprises two walls of low height, which face one another, it is easy to slide the block 3 into a container 2 or to remove it, the fingers being able to penetrate into the containers between the high walls.

When a block 3 is in position in its container 2, its pins 39 extend through corresponding office 49 provided in the bottom 1' of box 1, and it will be seen that this allows for very easy electrical connection of the seven motors necessary for the display of the seven segments of the "8" shown.

FIG. 1 illustrates two removable covers in the form of plates 4—4' which are positioned within container 1, on the upper portion of the high walls of the small containers 2, at the locations indicated by arrows F2, F3. These covers 4'—4' serve to hide the portions which are left free by cover 6 within the seven segments. These covers 4—4' are clipped on containers 2 by means of projections 7 which force fit into holes provided within the thickness of the upper walls of the containers 2.

The covers comprise lateral cutouts 34 for the passage of fingers 26–27 of the wheel blades 38 in display position. The edge of the covers is preferably rounded towards the interior of the container, except an edge running the length of central segment of the "8".

It is easy to understand that in an assembly thus achieved the cover 6 and the 2 covers 4—4' which are square (or parallelograms) are positioned in parallel planes and such that they allow seven slots 50 through which the seven wheel blades 38 can pass. It is possible for the segments to appear at 5A to form one number or another or to be in the hidden position 5B.

On the bottom 4' of the box and at the exterior is mounted a plate 40 in which seven by three small female pins are visible, which correspond to the seven by three male pins 39 of the seven motors. This plates 40 furthermore comprises a printed circuit which brings all of the electric connections to the bayonnet connector 41. Thus constituted the container of a number having seven segments can be connected by means of the female portion 42 of the bayonnet connector which can be connected to a flat cable 43. Thus not only is it easy to change a block 3 in a container 1, but it is likewise easy to change the entire container of a panel.

In the description which has just been given the stator supports 10 and 11, the rotor elements 18 and 20, the box elements 1, 4 and 6 are made of molded material. The stator elements 13 and 15 are made of soft iron, rotor 17 is a permanent bipolar magnet.

The construction described of a box having a single numeral is the most simple, but it obvious that, without going beyond the scope of the invention, it is possible to construct more complex containers, for example with fourteen segments making it possible to provide alphanumeric letter systems.

The apparatus according to the invention has, independently of its industrial design of manufacture very important advantages for the user which are:

each numeral is monoblock while being assembled in a single container;

it can be protected by a glass window shown in FIG. 1 at 44;

the attachment of the box 1 on a display panel is provided with two different possibilities, by exterior collar 45 on which one sees attachment holes 46, and a second attachment means exists because on the bottom of container 1 legs 47 are provided to receive attachment screws 48;

its electronic attachment is very simple by virtue of the bayonnet system previously described.

We claim:

1. A display apparatus comprising:

(a) a container;

(b) a plurality of open-fronted subcontainers, each positioned on the interior of the bottom of the container, the bottom of each comprising an orifice for receiving terminals;

(c) a plurality of display units equal in number to the subcontainers, each mounted in the open front of a different subcontainer for removal and replacement as a unit independent of the other display units, and each comprising:

(1) a display segment pivotably mounted in the display unit to pivot into and out of a display position;

(2) a motor for pivoting the display segment, the motor comprising:

(A) a plurality of male terminals which extend through the orifice in the bottom of the subcontainer;

(B) two support elements, one nestable in the other to form a support comprising two parallel, flexible side plates and a reel for receiving a wire;

(C) a rotor removably and rotatably mounted between the side plates, the rotor comprising:

(I) a circular magnet having a central hollow space;

(II) two end elements for supporting the magnet therebetween, each nestable in one of the side plates, and one nestable in the other through the central hollow space of the magnet; and (III) means for supporting the display segment; and (D) an armature for the reel comprising two stator elements mounted in the support, the first stator element positioned axial to the reel and having a lower, substantially straight portion and an upper, curved portion positioned on the rim of the magnet, and the second stator element having a lower, substantially straight portion positioned beneath the reel, and an upper, substantially straight portion substantially opposed to the first stator element on the rim of the magnet, and having a tip which curves over the rim of the magnet; and (d) a plate mounted on the exterior of the bottom of the container, comprising:

(1) a plurality of female receptors for receiving the male terminals of the motors to form electrical connections; and (2) a printed circuit for connecting all of the electrical connections to a bayonnet connector, for connection to a cable to provide electrical current to the motors.

2. The display apparatus of claim 1 wherein each display unit and its corresponding subcontainer have complimentary configurations of substantially square cross-sections, and wherein each subcontainer comprises two opposed walls of relatively lesser height and two opposed walls of relatively greater height.

3. The display apparatus of claim 11 wherein the magnet has an orifice for receiving a spur, and one of the end elements of the rotor has a spur which nests in the orifice upon the nesting of one of the end elements in the other, whereby rotation of the magnet causes rotation of the rotor.

4. The display apparatus of claim 1 wherein one of the side plates of the support has an interior curved slot, and wherein one of the end elements of the rotor has an exterior projection which nests in the curved slot when the rotor is mounted in the support, whereby rotational movement of the rotor is restricted.

5. The display apparatus of claim 1 wherein each end element of the rotor comprises a projection extending from the end element to balance the display segment.

6. The display apparatus of claim 1 comprising two weights, one attached to each end element of the rotor, for balancing the display segment.

7. The display apparatus of claim 1 wherein each of the two side plates comprises:

(a) an opening in its lower portion for allowing the support to open, receive the rotor, and close; and (b) a dove-tailed clip on the exterior of its upper portion for mounting the display unit in the subcontainer.

8. The display apparatus of claim 7 wherein:

(a) the display segment comprises a wheelblade;

(b) the means for supporting the display segment comprises two fingers integral with the display segment, one of the fingers being mounted in each end element of the rotor; and (c) each end element of the rotor comprises a slot for receiving one of the fingers.

9. The display apparatus of claim 1 comprising:

(a) a window cover movably mounted on the container to allow access to the display units; and, (b) a plurality of second covers mounted on the container to allow the display segments to be visible only when positioned in the display position.

10. The display apparatus of claim 9 comprising seven subcontainers arranged in two opposed parallelograms to form the numeral 8.

11. The display apparatus of claim 10 wherein:

(a) the second covers are positioned to provide seven slots through which the display elements can pass when pivoting into and out of the display position; and (b) two second covers are in the form of parallelograms, and are mounted one in each of the interior spaces formed by the parallelograms of the subcontainers, each of these two second covers comprising:

(1) a straight edge adjacent to the center segment of the numeral 8 configuration; and (2) three edges rounded towards the interior of the containers.

* * * * *

UNITED STATES PATENT AND TRADEMARK OFFICE

CERTIFICATE OF CORRECTION

PATENT NO. : 4,663,870

DATED : May 12, 1987

INVENTOR(S) : Jean-Pierre BODET et al.

It is certified that error appears in the above-identified patent and that said Letters Patent is hereby corrected as shown below:

At column 4, line 38, "plates 40" should be changed to ---plate 40---.

At column 6, line 5, "claim 11" should be changed to ---claim 1---.

At column 4, line 16, change "4'-4'" to ---4-4' ---.

At column 4, line 35, "4' " to -- 1' --.

Signed and Sealed this

Nineteenth Day of December, 1989

*Attest:*

JEFFREY M. SAMUELS

*Attesting Officer* *Acting Commissioner of Patents and Trademarks*